US006058621A

United States Patent [19]

Piccinino, Jr. et al.

[11] Patent Number: 6,058,621

[45] Date of Patent: May 9, 2000

[54] APPARATUS AND METHOD FOR DRYING PHOTOSENSITIVE MATERIAL USING RADIANT HEAT AND AIR FLOW PASSAGES

[75] Inventors: Ralph L. Piccinino, Jr., Rush; Kevin H. Blakely, Rochester; Daniel C. Davis, Rush; Raymond E. Wess, Holley, all of N.Y.

[73] Assignee: Eastman Kodak Company, Rochester, N.Y.

[21] Appl. No.: 09/092,593

[22] Filed: Jun. 5, 1998

[51] Int. Cl.[7] ..... F26B 3/34

[52] U.S. Cl. ..... 34/273; 34/277; 34/421; 34/620; 34/633

[58] Field of Search ..... 34/265, 267, 273, 34/277, 278, 420, 421, 429, 448, 459, 620, 629, 633; 396/606, 608, 614, 617

[56] References Cited

U.S. PATENT DOCUMENTS

| | | | |
|---|---|---|---|
| 3,364,062 | 1/1968 | Mitchell et al. . | |
| 3,720,002 | 3/1973 | Martin . | |
| 3,973,328 | 8/1976 | Theobald . | |
| 3,994,073 | 11/1976 | Lackore | 34/277 |
| 4,142,301 | 3/1979 | Goodall . | |
| 4,257,172 | 3/1981 | Townsend . | |
| 4,485,565 | 12/1984 | Ertl et al. . | |
| 5,070,627 | 12/1991 | Zagar | 34/633 X |
| 5,079,853 | 1/1992 | Kurokawa | 34/620 X |
| 5,323,546 | 6/1994 | Glover et al. . | |
| 5,561,913 | 10/1996 | Domoto | 34/620 X |
| 5,636,450 | 6/1997 | Lize | 34/273 X |
| 5,756,294 | 6/1998 | Puschnerat | 34/421 X |

FOREIGN PATENT DOCUMENTS

| | | |
|---|---|---|
| 0 068 207 | 1/1983 | European Pat. Off. . |
| 2 184 053 | 12/1973 | France . |

OTHER PUBLICATIONS

Patton et al., Replaceable Cartidge Coating Assembly and Method of Coating A U.S. Pat No. 5,905,924 Photosensitive Material Using The Same, USSN 08/9659639 (Docket No. 76810), filed Nov. 6, 1997, U.S. Pat No. 5,905,924.

Patton et al., A Coating Apparatus Having A Removable Coating Module For Applying A Protective Coating To Photosensitive Material, USSN 08/965,105, (Docket No. 76616), filed Nov. 6,1997,U.S. Pat No. 5,875,370.

*Primary Examiner*—Stephen Gravini
*Attorney, Agent, or Firm*—Frank Pincelli

[57] ABSTRACT

A drying apparatus and method utilizes radiant heat and forced air to provide for rapid drying of photosensitive material without emulsion side contact. The forced air is supplied through air passages formed between cover members that partially surround radiant heating bars, and is directed onto the photosensitive material where it impinges upon the photosensitive material. As the air passes through the air passages, it is heated by radiant heat from the heating bars. The heated air increases the drying effect of the drying apparatus and at the same time, impinges on the photosensitive material in a manner which assists in holding the photosensitive material firmly against, for example, drive rollers.

16 Claims, 3 Drawing Sheets

APPARATUS AND METHOD FOR DRYING PHOTOSENSITIVE MATERIAL USING RADIANT HEAT AND AIR FLOW PASSAGES

FIELD OF THE INVENTION

The present invention relates to the field of photoprocessing, and more particularly, to an apparatus and method for drying photosensitive material.

BACKGROUND OF THE INVENTION

When drying photosensitive material such as processed photosensitive material, photographic prints, cut sheets or film, the photosensitive material is traditionally conveyed through a dryer by way of guides and/or rollers which contact the photosensitive material. During drying of the photosensitive material it is beneficial that drying occurs in a rapid manner and that any contact on the emulsion side of the photosensitive material be minimized. By minimizing contact between the emulsion side of the photosensitive material and the guides and/or rollers, distortions or damage to the photosensitive materials decreased.

U.S. Pat. No. 3,973,328 discloses the application of radiant heat on both sides of a photographic sheet to dry the photographic sheet. U.S. Pat. No. 3,973,328 further shows the application of an air flow to the paper path. The air flow in U.S. Pat. No. 3,973,328 is a cool air flow which is maintained between 20° C. and 40° C. and assists in cooling down rollers located on each side of a radiant heating bar arrangement.

U.S. Pat. No. 4,257,172 discloses a radiant heating bar arrangement which includes ventilating passages. The dryer of U.S. Pat. No.4,257,172 is primarily for removing vaporous substances such as paints, adhesives, and moisture from a product. In this document, the use of the ventilating passages is to remove a vapor barrier.

SUMMARY OF THE INVENTION

The present invention relates to an apparatus and method for drying photosensitive material which utilizes the combination of radiant heat and forced air. In the present invention, radiant heating bars partially surrounded by reflective covers direct heat onto photosensitive material to dry the photosensitive material. Additionally, air is supplied through passages which are defined between the reflective covers onto the photosensitive material. This air is heated by heat from the heating bars which radiate through the reflective covers, and the heated air impinges upon the photosensitive material so as to increase the drying of the photosensitive material and at the same time hold the photosensitive material firmly against drive rollers within the drying apparatus.

One application of the present invention is to dry photosensitive material such as processed photosensitive material which has had a viscous solution of predetermined viscosity applied thereon; as shown in, for example, EP 915,377, U.S. Pat. No. 5,905,924 and U.S. Pat. No. 5,875,370, the subject matter of which is herein incorporated by reference. In this situation, a processed photosensitive material includes a solution of a predetermined viscosity applied thereon which forms a protective overcoat over the photosensitive material. During the drying of such a photosensitive material, it is important that the photosensitive material with the solution applied thereon be dried in a manner which does not disturb the applied solution. The system and apparatus of the present invention permits such a drying by using radiant heating bars on one side of the photosensitive material to dry the photosensitive material, and at the same time, impinging the photosensitive material with air that is heated by radiant heat from the heating bars to increase drying of the photosensitive material, and hold the photosensitive material firmly against drive rollers. Of course, the present invention is not limited to drying processed photosensitive material and/or processed photosensitive material having a viscous solution applied thereon as described above, and is also applicable to drying cut sheets, webs or any type of product which is desired to be dried in a manner which does not disturb the product or the surface of the product.

The present invention relates to an apparatus for drying photosensitive material which comprises a plurality of radiant heating bars for applying radiant heat to photosensitive material to dry the photosensitive material. Each of the radiant heating bars is partially surrounded by a cover member. In the apparatus of the present invention, air flow passages are defined between the cover members for the passage of the air therethrough, with the air passing through the air flow passages being directed onto the photosensitive material and being heated by heat from the heating bars which radiates through the cover members. The heated air is impinged onto the photosensitive material to increase drying of the photosensitive material.

The present invention also relates to a method of drying photosensitive material which comprises the step of applying radiant heat by way of radiant heating bars to photosensitive material to dry the photosensitive material. The heating bars are each partially surrounded by cover members, wherein an air flow passage is defined between each of the cover members. The method of the present invention comprises the further step of directing air through each of the air flow passages such that the air is heated by heat from the heating bars which radiates through the cover members, with the heated air being impinged onto the photosensitive material to increase drying of the photosensitive material.

The present invention also relates to a photoprocessing system which comprises a photoprocessing assembly for processing photosensitive material; and a drying apparatus for drying the processed photosensitive material. The drying apparatus comprises a plurality of radiant heating bars for applying radiant heat to the processed photosensitive material to dry the processed photosensitive material, with each of the radiant heating bars being partially surrounded by a cover member. Air flow passages are defined between the cover members for the passage of air therethrough. The air passing through the air flow passages is directed onto the processed photosensitive material and is heated by heat from the heating bars which radiates through the cover members, such that the heated air is impinged onto the processed photosensitive material to increase drying of the processed photosensitive material.

The present invention further relates to a photoprocessing method which comprises the steps of processing a photosensitive material; applying radiant heat by way of radiant heating bars to the processed photosensitive material to dry the processed photosensitive material, with the radiant heating bars being partially surrounded by cover members, wherein an air flow passage is defined between each of said cover members; and directing air through each of the air flow passages such that the air is heated by heat from the heating bars which radiates through the cover members, with the heated air being impinged onto the processed photosensitive material to increase drying of the processed photosensitive material.

DETAILED DESCRIPTION OF THE INVENTION

Figure 1:
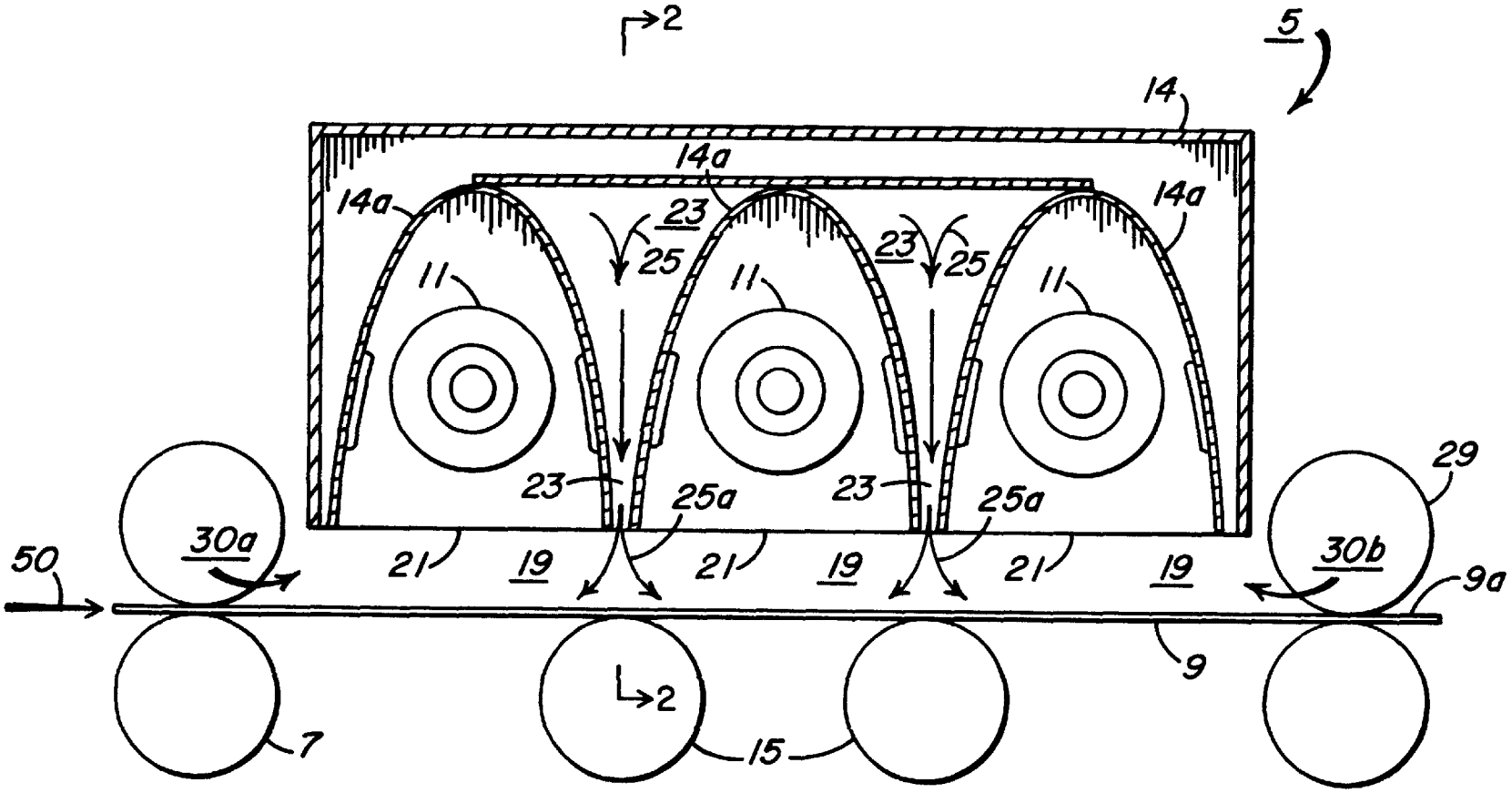
FIG. 1 is a schematic illustration of a drying apparatus in accordance with the present invention.

Referring now to FIG. 1, an apparatus 5 for drying photosensitive material is shown. In the embodiment as illustrated in FIG. 1, apparatus 5 is positioned downstream of, for example, a coating apparatus (not shown) and a metering roller 7, with respect to a photosensitive material conveying direction 50. When utilized in this manner, apparatus 5 dries photosensitive material 9 onto which has been applied a solution of predetermined viscosity which forms a protective overcoat, (see EP915,377, U.S. Pat. No. 5,905,924 and U.S. Pat. No. 5,875,370). That is, after photosensitive material 9 has been coated with a viscous solution, the applied solution is metered by way of metering rollers 7 and lead to drying apparatus 5. This is just one example for using drying apparatus 5 of the present invention It is recognized that drying apparatus 5 is not limited to drying photosensitive material having a viscous solution applied thereon, and is also not limited to being utilized downstream of a coating apparatus or metering roller. Drying apparatus 5 is applicable to dry any type of photosensitive material, photographic print, cut web or sheet, or any type of paper product in which drying is desired. Drying apparatus 5 can also be positioned at various locations of a processing system in which drying is desired.

As illustrated in FIG. 1, drying apparatus 5 includes radiant heating bars 11 which are located on one side and above photosensitive material 9. Radiant heating bars 11 extend transversely with respect to conveying direction 50 and can be set up as an array of sequential radiant heating bars as illustrated in FIG. 1. Additionally, a cover 14 such as a reflective cover or shroud partially surrounds radiant heating bars 11 so as to assist in directing radiant heat onto a top side or emulsion side 9*a* of photosensitive material 9. Cover 14 includes a plurality of cover members 14*a* which each surround a corresponding radiant heating bar 11.

Thus, as illustrated in FIG. 1, as photosensitive material 9 enters drying apparatus 5 at entrance 30*a*, it is conveyed through drying apparatus 5 in direction 50. Photosensitive material 9 is transported by way of drive rollers 15 which support the bottom of photosensitive material 9 as it is conveyed through drying apparatus 5. Within drying apparatus 5, a heating chamber 19 is defined between the top or emulsion side 9a of photosensitive material 9 and openings 21 of cover members 14*a*. Accordingly, radiant heat from radiant heating bars 11 is directed onto photosensitive material 9 as photosensitive material 9 passes below radiant heating bars 11 to dry photosensitive material 9.

As further illustrated in FIG. 1, cover 14 comprises a plenum in the form of inwardly tapering air passages 23 that extend between each of cover members 14*a*. With this arrangement, air can be supplied by way of, for example, an air blower (not shown) into each of air passages 23 as illustrated by arrows 25. As the air passes through each of air passages 23, the air is heated to a temperature preferably within a range of 150° F. to 200° F. by heat from heating bars 11 which radiates through cover members 14*a*. The heated air passes through air passages 23 which inwardly taper and expands as the air enters heating chamber 19 as illustrated by arrows 25*a*. As the air enters heating chamber 19, it is impinged or forced against top or emulsion surface 9*a* of photosensitive material 9 to further aid in drying of the photosensitive material 9. It is further recognized that the present invention can incorporate a known auxiliary heating source to increase the temperature of the air prior to entering the drying apparatus.

After photosensitive material 9 is dried, it can be conveyed through an exit 30*b* of drying apparatus 5 by way of, for example, drive rollers 29.

Therefore, with the arrangement of the present invention, as photosensitive material 9 is transported in direction 50 through drying apparatus 5, radiant heat and forced heated air are alternatively and sequentially applied to surface 9*a* of photosensitive material 9.

In a further feature of the present invention, the heated air which exits air passages 23 is applied to photosensitive material 9 with a force that is sufficient enough to firmly hold photosensitive material 9 against drive rollers 15. This assures that photosensitive material 9 is maintained flat without requiring the use of rollers or guides which tend to touch the emulsion side of the photosensitive material 9. Thus, damage or distortion of photosensitive material 9 is minimized.

Therefore, the heated air which passes through air passages 23 serves the dual purpose of increasing the drying effect of drying apparatus 5 and holding photosensitive material 9 firmly flat against drive rollers 15. As illustrated in FIG. 1, in order to enhance the ability of the forced air to hold photosensitive material 9 against drive rollers 15, air passages 23 can be located such that they are positioned over a corresponding drive roller 15 as shown.

Figure 2:
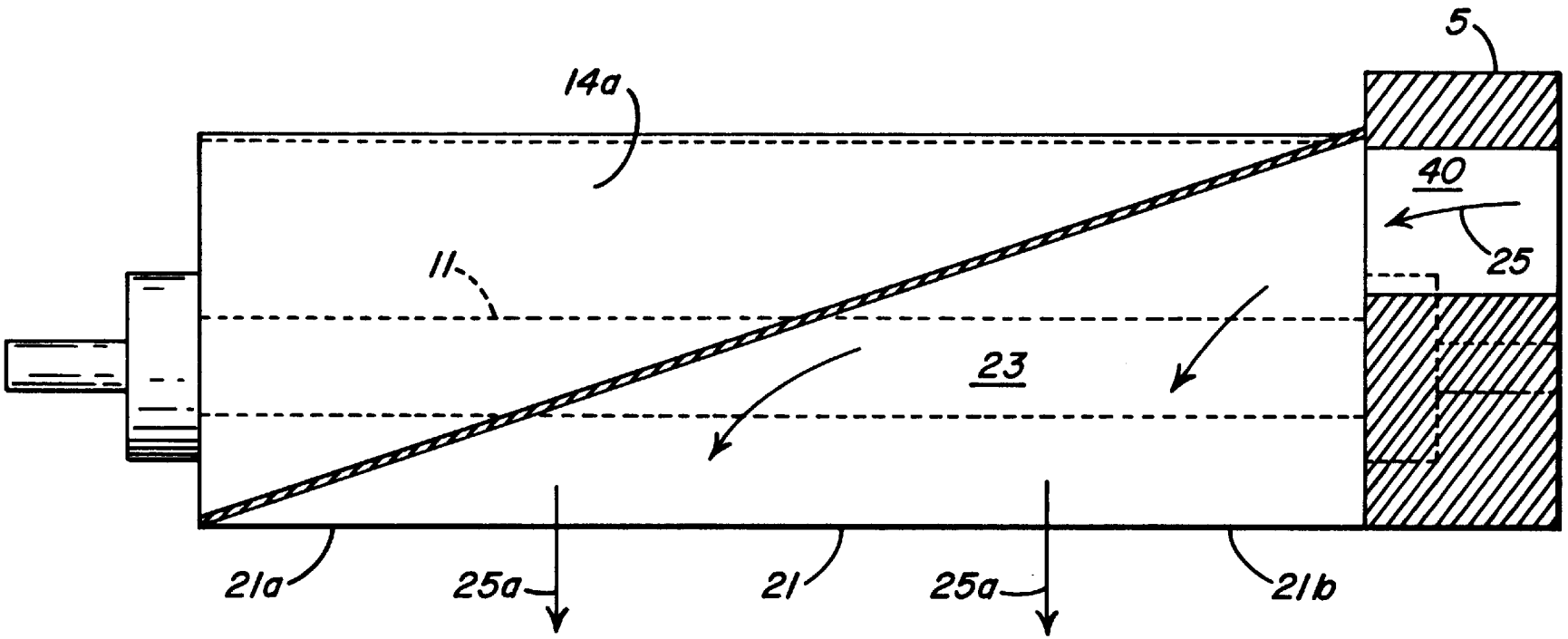
FIG. 2 is a sectional view along line II—II of FIG. 1.

Also, as shown in FIG. 2, each of air passages 23 extend transversely with respect to conveying direction 50, and drying apparatus 5 includes an air cavity entry port 40 in communication with each air passage 23. As illustrated in FIG. 2, each air passage 23 is sloped or inclined in a downward direction from air cavity entry port 40. With this arrangement, air which exits air passage 23 at a downstream area 21*a* will have a force which is substantially equal to air which exits air passage 23 at an upstream area 21*b*. This assures that the air will impinge onto photosensitive material 9 with a substantially equal force along the width of photosensitive material 9 so as to eliminate any uneven drying.

Figure 3:
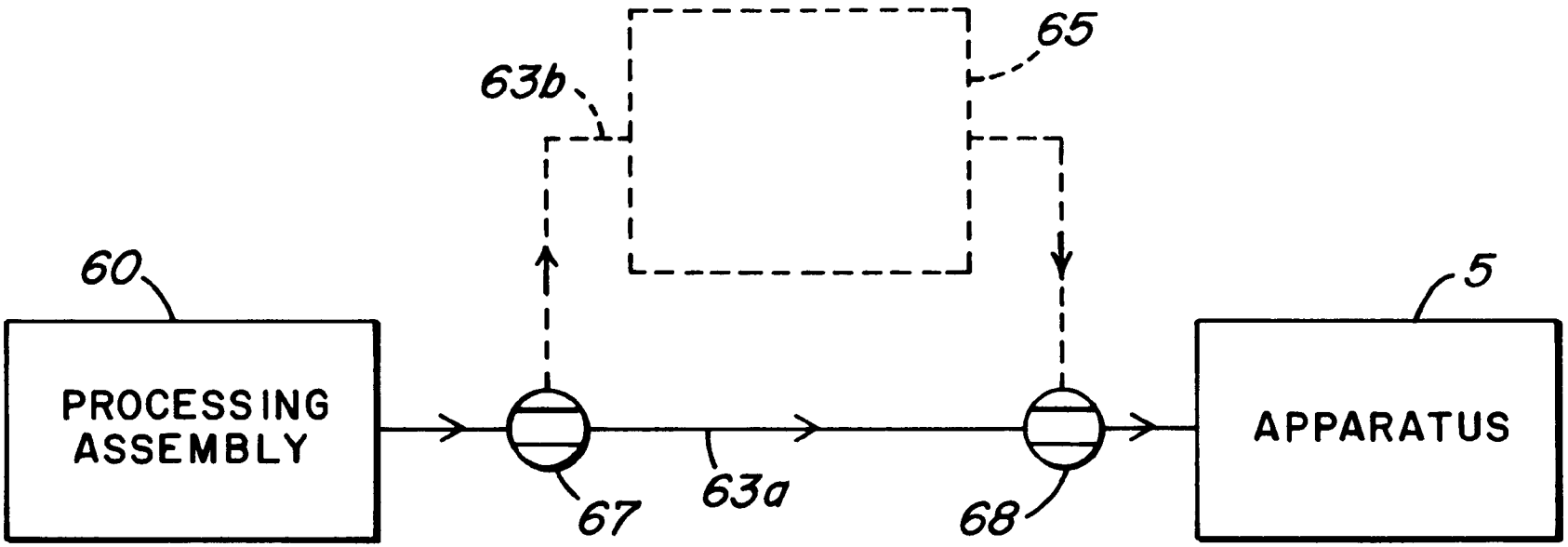
FIG. 3 is a schematic illustration of a photoprocessing system in accordance with the present invention.

FIG. 3 schematically illustrates an example of a photoprocessing system to which drying apparatus 5 of the present invention can be applied. As shown in FIG. 3, drying apparatus 5 (the details of which are shown and described above with reference to FIGS. 1 and 2) can be placed downstream of a processing assembly 60. Processing assembly 60 can be a known arrangement which includes tanks that respectively contain developer solution, bleach solution, fixer solution and washing solution; or a combination of bleach-fix solution and a wash/stabilizer solution. Each of the tanks of processing assembly 60 represent steps in the developing process of photosensitive material. In one embodiment, after processed photosensitive material leaves processing assembly 60, it is conveyed through path 63*a* into drying apparatus 5 where it is dried as described above with reference to FIGS. 1 and 2.

In a further embodiment, a coating apparatus 65, such as described in, for example, copending applications U.S. Ser. No. 08/965,560, U.S. Ser. No. 08/965,639 and U.S. Ser. No. 08/965,105, can be located in between processing assembly 60 and drying apparatus 5. That is, coating apparatus 65 can be placed in path 63*a* between processing assembly 60 and drying apparatus 5, so that the processed photosensitive material exiting processing assembly 60 is coated with a solution at coating apparatus 65 and then conveyed to drying apparatus 5. Drying apparatus 5 of the present invention is effective to dry processed photosensitive material having a viscous solution applied thereon.

As a further option and as shown in FIG. 3, coating apparatus 65 can be placed in a bypass line 63*b* between processing assembly 60 and drying apparatus 5. With this arrangement and through the use of diverters 67,68, after the processed photosensitive material exits processing assembly 60, diverters 67 and 68 are operable in a first mode to bypass coating apparatus 65 and lead the processed photosensitive material via path 63*a* to drying apparatus 5, and operable in a second mode to lead the processed photosensitive material to coating apparatus 65 via line 63*b*, and thereafter to drying apparatus 5.

Accordingly, the present invention provides for an arrangement which permits rapid drying of photosensitive material, such as processed photosensitive material having a solution of predetermined viscosity applied thereon, photographic prints, cut sheets, webs, etc. The drying apparatus of the present invention includes heating bars on one side of the photosensitive materials and drive rollers on an opposite side of the photosensitive material which provides for a compact arrangement. Additionally, the arrangement of the present invention permits a rapid drying without the necessity of emulsion side contact.

The invention has been described in detail with particular reference to certain preferred embodiments thereof, but it will be understood that variations and modifications can be effected within the spirit and scope of the invention.

What is claimed is:

1. An apparatus for drying photosensitive material, the apparatus comprising:

a plurality of radiant heating bars for applying radiant heat to photosensitive material to dry the photosensitive material, each of said radiant heating bars being partially surrounded by a cover member;

wherein air flow passages are defined between said cover members for the passage of air therethrough, said air passing through said air flow passages being directed onto said photosensitive material and being heated by heat from said heating bars which radiates through said cover members, such that said heated air is impinged onto said photosensitive material to increase drying of said photosensitive material.

2. An apparatus according to claim 1, further comprising drive rollers for transporting the photosensitive material through said apparatus, wherein said heated air impinged on said photosensitive material holds said photosensitive material flat against said drive rollers.

3. An apparatus according to claim 1, wherein said photosensitive material is a processed photosensitive material.

4. An apparatus according to claim 1, wherein said photosensitive material is one of a photographic print, a cut sheet or a web.

5. An apparatus according to claim 1, wherein each of said air flow passages inwardly taper in an air flow direction.

6. An apparatus according to claim 2, wherein each of said air flow passages opens toward said photosensitive material at area above a corresponding one of said drive rollers.

7. An apparatus according to claim 2, wherein said radiant heating bars, said cover members and said air flow passages are provided on one side of said photosensitive material, and said drive rollers are provided on an opposite side of said photosensitive material.

8. An apparatus according to claim 1, wherein each of said air passages are inclined in a width-wise direction of said photosensitive material.

9. A method of drying photosensitive material, the method comprising the steps of:

applying radiant heat by way of radiant heating bars to photosensitive material to dry the photosensitive material, said radiant heating bars being partially surrounded by cover members, wherein an air flow passage is defined between each of said cover members; and directing air through each of said air flow passages such that said air is heated by heat from said heating bars which radiate through said cover members, said heated air being impinged onto said photosensitive material to increase drying of said photosensitive material.

10. A method according to claim 9, comprising the further step of conveying said photosensitive material below said radiant heating bars and said air flow passages by way of drive rollers, wherein said heated air impinged onto said photosensitive material holds said photosensitive material against said drive rollers.

11. A method according to claim 9, wherein said photosensitive material is a processed photosensitive material.

12. A method according to claim 9, wherein said photosensitive material is one of a photographic print, cut sheet or web.

13. A photoprocessing system comprising:

a processing assembly for processing photosensitive material; and a drying apparatus for drying said processed photosensitive material, said drying apparatus comprising a plurality of radiant heating bars for applying radiant heat to said processed photosensitive material to dry said processed photosensitive material, each of said radiant heating bars being partially surrounded by a cover member;

wherein air flow passages are defined between said cover members for the passage of air therethrough, said air passing through said air flow passages being directed onto said processed photosensitive material and being heated by heat from said heating bars which radiates through said cover members, such that said heated air is impinged onto said processed photosensitive material to increase drying of said processed photosensitive material.

14. A photoprocessing system according to claim 13, wherein said drying apparatus further comprises drive rollers for transporting the processed photosensitive material through said drying apparatus, wherein said heated air impinged on said processed photosensitive material holds said processed photosensitive material flat against said drive rollers.

15. A photoprocessing method comprising the steps of:

processing a photosensitive material;

applying radiant heat by way of radiant heating bars to said processed photosensitive material to dry said processed photosensitive material, said radiant heating bars being partially surrounded by cover members, wherein an air flow passage is defined between each of said cover members; and directing air through each of said air flow passages such that said air is heated by heat from said heating bars which radiate through said cover members, said heated air being impinged onto said processed photosensitive material to increase drying of said processed photosensitive material.

16. A method according to claim 15, comprising the further step of conveying said processed photosensitive material below said radiant heating bars and said air flow passages by way of drive rollers, wherein said heated air impinged onto said processed photosensitive material holds said processed photosensitive material against said drive rollers.

* * * * *